US010934074B2

(12) United States Patent
Hu

(10) Patent No.: US 10,934,074 B2
(45) Date of Patent: Mar. 2, 2021

(54) BUFFER STRUCTURE AND PACKAGING BOX

(71) Applicants: HKC Corporation Limited, Guangdong (CN); CHONGQING HKC OPTOELECTRONICS TECHNOLOGY CO., LTD., Chongqing (CN)

(72) Inventor: Xiaogang Hu, Guangdong (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 111 days.

(21) Appl. No.: 16/278,110

(22) Filed: Feb. 17, 2019

(65) Prior Publication Data

US 2020/0172315 A1 Jun. 4, 2020

Related U.S. Application Data

(63) Continuation of application No. PCT/CN2018/121835, filed on Dec. 18, 2018.

(30) Foreign Application Priority Data

Dec. 4, 2018 (CN) ..... 201822029801.7

(51) Int. Cl.
*B65D 81/113* (2006.01)
*B65D 85/68* (2006.01)

(52) U.S. Cl.
CPC ..... *B65D 81/113* (2013.01); *B65D 85/68* (2013.01); *B65D 2585/6835* (2013.01)

(58) Field of Classification Search
CPC ..... B65D 81/113; B65D 85/68; B65D 2585/6835; B65D 25/107; B65D 25/10;
(Continued)

(56) References Cited

U.S. PATENT DOCUMENTS 6,206,195 B1 3/2001 Cheng
9,010,534 B2 * 4/2015 Kuo ..... B65D 81/052 206/454

(Continued)

FOREIGN PATENT DOCUMENTS

CN 201128567 Y 10/2008
CN 102795422 A 11/2012

(Continued)

OTHER PUBLICATIONS

International Search Report of PCT Patent Application No. PCT/CN2018/121835 dated Sep. 9, 2019.

*Primary Examiner* — Steven A. Reynolds

(57) ABSTRACT

The present disclosure provides a buffer structure and a packaging box, the buffer structure includes a fixing frame, the fixing frame includes a mounting plate and a supporting plate, the mounting plate connects to the box body, the supporting plate includes a first surface and a second surface arranged opposite to each other, and includes an adjusting hole running through the first surface and the second surface; an adjusting component, the adjusting component includes an adjusting member, and a fixing member, the adjusting component passes through the adjusting hole, the fixing member connects to an end of the adjusting member and stops against the first surface, the other end of the adjusting member abuts the second surface; and a buffer member, the buffer member connects to a surface of the adjusting member away from the supporting plate.

18 Claims, 7 Drawing Sheets

(58) Field of Classification Search
CPC .. B65D 81/058; B65D 81/053; B65D 81/022; B65D 81/05; B65D 81/057
USPC ..... 206/521, 453, 586, 591, 592, 594, 454, 206/722
See application file for complete search history.

(56) References Cited

U.S. PATENT DOCUMENTS

| | | | | |
|---|---|---|---|---|
| 10,392,176 | B1 * | 8/2019 | Hu | B65D 85/68 |
| 2013/0299375 | A1 * | 11/2013 | Chen | B29C 33/306 206/454 |
| 2013/0306514 | A1 * | 11/2013 | Hu | B65D 81/053 206/586 |
| 2014/0032422 | A1 * | 1/2014 | Jones | G06Q 30/016 705/304 |
| 2014/0097121 | A1 * | 4/2014 | Chen | B65D 85/48 206/586 |
| 2020/0071052 | A1 * | 3/2020 | Cheng | B65D 81/054 |

FOREIGN PATENT DOCUMENTS

| | | | |
|---|---|---|---|
| CN | 104309896 | A | 1/2015 |
| CN | 105564819 | A | 5/2016 |
| CN | 107972992 | A | 5/2018 |

* cited by examiner

BUFFER STRUCTURE AND PACKAGING BOX

CROSS-REFERENCE TO RELATED APPLICATIONS

The present application is a Continuation Application of PCT Application No. PCT/CN2018/121835, filed Dec. 18, 2018, which claims the benefit of China Patent Application No. CN201822029801.7, filed Dec. 4, 2018, with the State Intellectual Property Office and entitled "Buffer Structure and Packaging Box", the entirety of which is hereby incorporated herein by reference.

TECHNICAL FIELD

The present disclosure generally relates to the technical field of packaging, and more particularly relates to a buffer structure, and a packaging box using the buffer structure.

BACKGROUND

Display panels are usually packaged and transported in specific boxes. In the packaging box, an unadjustable buffer structure is usually installed for edges of the display panel to buffer, to prevent the display panel from directly contacting the packaging box to cause abrasion. However, during transportation, the packaging box may shake or collide seriously under the action of an external force, while the unadjustable buffer structure cannot overcome the external force completely, which may cause deformation or breakage of the display panel.

SUMMARY

It is therefore one main object of the disclosure to provide a buffer structure, which aims to enable the packaging box using the buffer structure to better protect the display panel in the box and prevent the display panel from being damaged under the action of external force.

In order to realize the above aim, the buffer structure provided by the present disclosure is configured as a packaging box of the display panel, the packaging box includes a box body, the buffer structure includes:

a fixing frame, the fixing frame includes a mounting plate and a supporting plate, the mounting plate connects to the box body, the supporting plate includes a first surface and a second surface arranged opposite to each other, and includes an adjusting hole running through the first surface and the second surface;

at least one adjusting component, the adjusting component includes at least one adjusting member, at least one fixing member, and at least one elastic member, the adjusting component passes through the adjusting hole, the fixing member connects to an end of the adjusting member and stops against the first surface, and the elastic member is clamped between the other end of the adjusting member and the second surface; and a buffer member, the buffer member connects to an end surface of the adjusting member and located on a side of the elastic member away from the supporting plate.

Electively, the adjusting member includes an adjusting rod and a connecting plate, the adjusting rod passes through the adjusting hole, the fixing member connects to one end of the adjusting rod and stops against the first surface, the connecting plate connects to the other end of the adjusting rod, and the elastic member is clamped between the connecting plate and the second surface;

the buffer member connects to the surface of the connecting plate away from the adjusting rod.

Electively, one end of the elastic member is fixed to the connecting plate, and the other end of the elastic member abuts the second surface.

Electively, the adjusting rod passes through the adjusting hole along the extending direction of the adjusting rod, and includes a plurality of inserting holes arranged side by side along the extending direction, and the fixing member is inserted into one inserting hole in the adjusting rod.

Electively, the fixing member includes an inserting rod and a stop part connected to one end of the inserting rod, the radial dimension of the inserting rod is smaller than the inner diameter of the inserting hole, the radial dimension of the stop part is larger than the inner diameter of the inserting hole, and the inserting rod passes through one corresponding inserting hole in the adjusting rod along a direction away from the stop part.

Electively, the adjusting member includes a plurality of adjusting rods, the supporting plate includes a plurality of adjusting holes, one end of each adjusting rod connects to the connecting plate, and the other end of each adjusting rod passes through one corresponding adjusting hole.

Electively, the plurality of the adjusting rods are arranged side by side, and one of the fixing members connects to a plurality of the adjusting members simultaneously.

Electively, the supporting plate defines a limit groove, the second surface is defined at the bottom of the limit groove, and the connecting plate matches with the limit groove in size.

Electively, the fixing frame includes two supporting plates cooperatively forming an angle, the buffer structure includes two adjusting components and two buffer members, one supporting plate, one adjusting component, and one buffer member are cooperatively mounted together, and the two buffer members face the display panel in the box body.

Electively, the fixing frame includes two mounting plates, each of the mounting plates is defined at an extension line of one supporting plate.

Electively, the two supporting plates are perpendicular to each other.

Electively, an edge of the mounting plate away from the supporting plate bends and extends sideways.

The present disclosure provides a buffer structure applied to a packaging box of display panel, the packaging box includes a box body, the buffer structure includes:

a fixing frame, the fixing frame includes two mounting plates and two supporting plates, the two mounting plates are perpendicular to each other and respectively defined at an extension line of one of the supporting plates; the two mounting plates connect to the box body, each of the supporting plates includes a first surface and a second surface opposite to the first surface, and includes a plurality of adjusting holes passing through the first surface and the second surface;

two adjusting components, one adjusting component connects to one corresponding supporting plate, and the adjusting component includes at least a connecting plate and a plurality of adjusting rods connected to the connecting plate, a fixing member, and a plurality of elastic members, each adjusting rod passes through one corresponding adjusting hole, and each adjusting rod includes a plurality of inserting holes arranged side by side along the extending direction of the adjusting rod; the fixing member includes an inserting rod and a stop part connected to one end of the inserting rod, the inserting rod passes through one corresponding inserting hole in each adjusting rod along a direction away from the stop part and stops against the first surface, and the plurality of elastic members are clamped between the connecting plate and the second surface; and a buffer member, the buffer member connects to a surface of the connecting plate away from the adjusting rod.

The present disclosure provides a packaging box, the packaging box includes a box body and a buffer structure, the packaging box includes an inserting groove matched with the mounting plate, and the mounting plate is cooperatively inserted into the inserting groove;

the buffer structure includes:

a fixing frame, the fixing frame includes a mounting plate and a supporting plate, the mounting plate connects to the box body, the supporting plate includes a first surface and a second surface arranged opposite to each other, and includes an adjusting hole running through the first surface and the second surface;

at least one adjusting component, the adjusting component includes at least one adjusting member, at least one fixing member, and at least one elastic member, the adjusting component passes through the adjusting hole, the fixing member connects to an end of the adjusting member and stops against the first surface, and the elastic member is clamped between the other end of the adjusting member and the second surface; and a buffer member, the buffer member connects to an end surface of the adjusting member and located on a side of the elastic member away from the supporting plate.

Electively, the mounting plate includes a first side plate and a second side plate, the first side plate connects to one supporting plate and extends toward an extension line of the supporting plate, and the second side plate connects to a side of the first side plate away from the supporting plate and extends toward a lateral direction of the first side plate; and the inserting groove includes a first inserting section and a second inserting section communicating with the first inserting section, the first side plate is inserted into the first inserting section, and the second side plate is inserted into the second inserting section.

In the technical solution of the present disclosure, the buffer structure includes the fixing frame, the adjusting component, and the buffer member, the fixing frame includes the mounting plate arranged to be connected with the box body and the supporting plate arranged to support the buffer member, and the adjusting member connects to the supporting plate and the buffer member. In the process of transporting or handling the packaging box, the display panel in the packaging box can directly contact the buffer member which can buffer the display panel to a certain extent, thus reducing the impact force on the display panel.

The supporting plate includes the first surface and the second surface arranged opposite to each other, and includes the adjusting hole running through the first surface and the second surface, the adjusting member passes through the adjusting hole, and the fixing member connects to the adjusting member and stops against the first surface of the supporting plate so that one end of the adjusting member is stopped by the fixing member to prevent movement of the adjusting member along the direction from the first surface to the second surface. The other end of the adjusting member elastically abuts against the second surface of the supporting plate, so that the movement of the adjusting member along the direction from the second surface to the first surface can be further buffered, and when the display panel shakes inside the box, the force applied to the buffer member by the display panel can be further absorbed by the elastic member between the adjusting member and the second surface, thereby further ensuring that the display panel is not damaged during transportation.

BRIEF DESCRIPTION OF THE DRAWINGS

To better illustrate the technical solutions that are reflected in various embodiments according to this disclosure or that are found in the prior art, the accompanying drawings intended for the description of some embodiments herein or for the prior art may now be briefly described, it is evident that the accompanying drawings listed in the following description show merely some embodiments according to this disclosure, and that those having ordinary skill in the art may be able to obtain other drawings based on the arrangements shown in these drawings without making inventive efforts.

Figure 1:
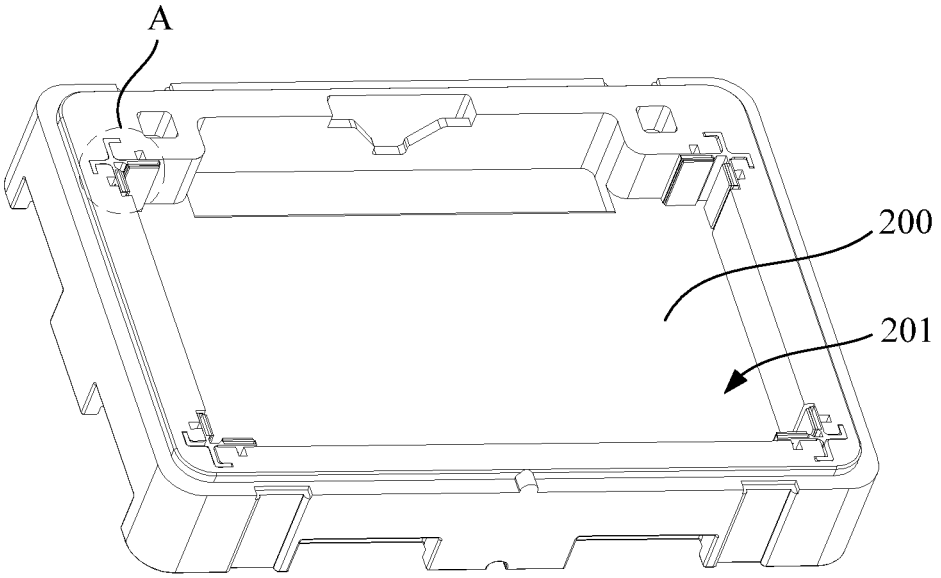
FIG. 1 is a structural diagram of the packaging box of the present disclosure according to some embodiments.
Figure 2:
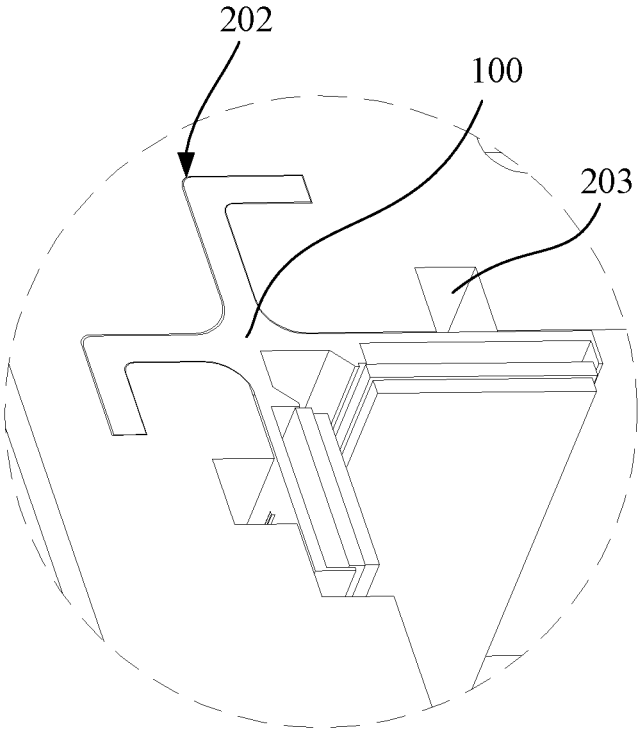
FIG. 2 is an enlarged diagram of portion A shown in FIG. 1.

The realization of the aim, functional characteristics, advantages of the present disclosure are further described specifically with reference to the accompanying drawings and embodiments.

DETAILED DESCRIPTION

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

It is to be understood that, all of the directional instructions in the exemplary embodiments of the present disclosure (such as top, down, left, right, front, back) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides a buffer structure 100, which can be used not only for packaging and transporting display panels, but also for buffering and packaging precision instruments, instruments, precious instruments, household appliances, glass and ceramic products, handicrafts, valuables, high-grade handicrafts and the like.

In some embodiments, the buffer structure 100 is optionally provided as a packaging box for the display panel, and the packaging box for the display panel is provided for packaging the display panel. The display panel may be a twisted nematic (TN) type panel, a vertical alignment (VA) panel, an in-plane switching (IPS) panel, a continuous pinwheel alignment (CPA) panel, an advanced super dimension switch (ADSDS) based panel, and the like.

It may be understood that the display panel may be a liquid crystal panel, which connects to the circuit board through a chip on flex, or, a chip on film (COF), and arranged to realize signal transmission. The liquid crystal panel is prone to break when impacted or vibrated by external force, resulting in scrapping, so it is especially necessary to prevent the liquid crystal panel from being damages during its transportation process.

Referring to FIGS. 1 to 7, in some embodiments of the present disclosure, the buffer structure 100 should be provided as a packaging box, and the packaging box includes a box body 200, and the buffer structure 100 includes:

a fixing frame 10, which includes a mounting plate 11 and a supporting plate 13, the mounting plate 11 connects to the box body 200, and the supporting plate 13 includes a first surface 132 and a second surface 134 arranged opposite to each other, and includes an adjustment hole 131 passing through the first surface 132 and the second surfaces 132 and 134;

at least one adjusting component 30, which includes at least one adjusting member 31, at least one fixing member 33, and at least one elastic member 35, the adjusting member 31 passes through the adjusting hole 131, the fixing member 33 connects to one end of the adjusting member 31 and stops against the first surface 132, and the elastic member 35 is clamped between the other end of the adjusting member 31 and the second surface 134;

a buffer member 50, which connects to an end surface of the adjusting member 31 and located on a side of the elastic member 35 away from the supporting plate 13.

Figure 5:
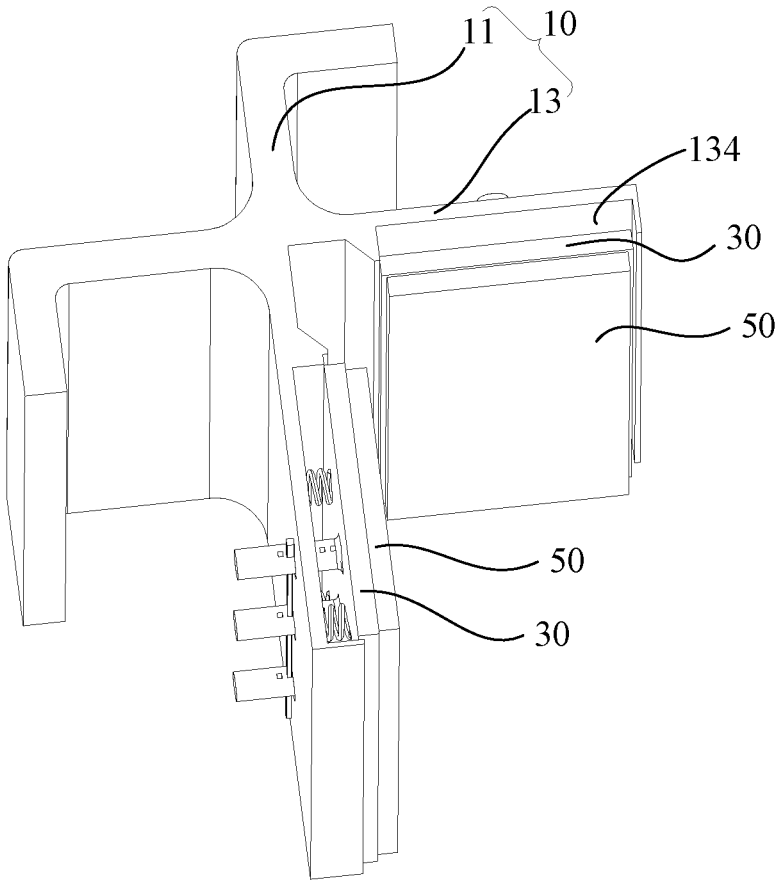
FIG. 5 is a structural diagram of the buffer structure of the present disclosure according to some embodiments.
Figure 6:
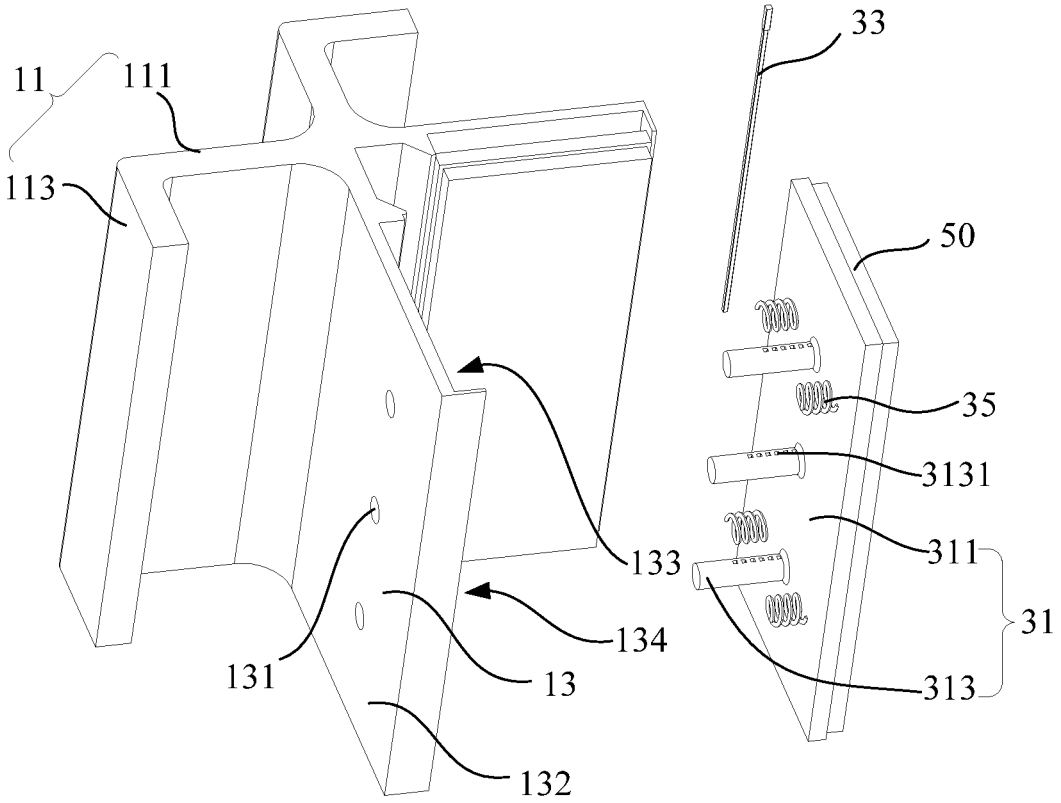
FIG. 6 is an exploded diagram of a part of the structure shown in FIG. 5.

Referring to FIGS. 5 and 6, in the technical solution of the present disclosure, the buffer structure 100 includes the fixing frame 10, the adjusting component 30, and the buffer member 50, the fixing frame 10 includes the mounting plate 11 connected to the box body 200 and a supporting plate 13 arranged to support the buffer member 50, the adjusting member 31 connects to the supporting plate 13 and the buffer member 50. In the process of transporting or handling the packaging box, the display panel in the packaging box can directly contact the buffer member 50, the buffer member 50 can buffer the display panel to a certain extent, thereby reducing the impact force on the display panel.

According to the technical solution of the present disclosure, the supporting plate 13 includes a first surface 132 and a second surface 134 arranged opposite to each other, and includes an adjustment hole 131 running through the first surface 132 and the second surface 134, the adjustment member 31 passes through the adjusting hole 131, and the fixing member 33 connects to the adjustment member 31 and stops against the first surface 132 of the supporting plate 13, so that one end of the adjustment member 31 is stopped by the fixing member 33 to prevent the movement of the adjustment member 31 along the direction from the first surface 132 to the second surface 134. The other end of the adjusting member 31 is elastically abutted against the second surface 134 by the elastic member 35, so that the movement of the adjusting member 31 along the direction from the second surface 134 to the first surface 132 can be further buffered by the elastic member 35. When the display panel shakes in the box body 200, the force exerted by the display panel on the buffer member 50 can be further absorbed by the elastic member 35, thereby further ensuring that the display panel will not damaged during transportation.

The fixing frame 10 is made of acrylonitrile-butadiene-styrene plastic (ABS), polyethylene (PE), or polypropylene (PP), etc. Of course, the fixing frame 10 includes but is not limited to ABS, PE, PP and other materials, which is not limited here. The buffer member 50 is made of silica gel, foam, or other elastic material, which is not limited here.

In some embodiments, the adjusting member 31 merely includes a connecting rod, and the buffer member 50 is directly connected to the end of the connecting rod to buffer the display panel.

Referring to FIG. 5, the adjusting member 31 includes an adjusting rod 313 and a connecting plate 311. The adjusting rod 313 passes through the adjusting hole 131, the fixing member 33 connects to one end of the adjusting rod 313 and stops against the first surface 132, the connecting plate 311 connects to the other end of the adjusting rod 313, and the elastic member 35 is clamped between the connecting plate 311 and the second surface 134.

The buffer member 50 connects to the surface of the connecting plate 311 away from the adjusting rod 313.

In some embodiments, the adjusting member 31 is composed of the adjusting rod 313 and the connecting plate 311, the connecting plate 311 connects to one end of the adjusting rod 313 and is configured to connect the buffer member 50. It can be understood that the area of the connecting plate 311 is larger than the area of the end of the adjusting rod 313, and the shape of the buffer member 50 matches with the shape of the connecting plate 311, so that the contact area between the display panel and the buffer member 50 can be increased, and the force on the buffer member 50 applied by the display panel can be dispersed, which is more conducive to improving the buffer effect on the display panel.

The elastic members 35 can be selected as spring. In some embodiments, there are a plurality of elastic members 35, and the plurality of elastic members 35 are spaced from each other.

In some embodiments, one end of the adjusting rod 313 is stopped against the first surface 132 through the fixing member 33 to prevent the buffer member 50 connected to the connecting plate 311 from moving along the direction from the first surface 132 to the second surface 134. The elastic member 35 is clamped between the connecting plate 311 and the second surface 134. When the display panel in the packaging box hits the buffer member 50, the buffer member 50 and the elastic member 35 cooperatively buffer the impact force, thereby further ensuring that the display panel in the packaging box will not be damaged. The adjusting rod 313 has a columnar shape, and the cross section of the adjusting member 31 may be circular or polygonal.

Electively, one end of the elastic member 35 is fixed to the connecting plate 311 and the other end abuts against the second surface 134. Furthermore, the adjusting rod 313 and the connecting plate 311 are of an integral structure, thereby making the mounting operation of the buffer structure 100 easier.

The adjusting rod 313 passes the adjusting hole 131 along the extending direction of the adjusting rod 313 and defines a plurality of inserting holes 3131 arranged side by side along the extending direction. The fixing member 33 is inserted into one inserting hole 3131 on the adjusting rod 313.

In some embodiments, by inserting the fixing member 33 into different inserting holes 3131, it is possible to adjust the distance between the connecting plate 311 and the second surface 134. When the distance gap between the inner wall of the box body 200 and the display panel is too small or too large, it can be adjusted by the matching the fixing member 33 with different inserting holes 3131, so that the inner wall of the box body 200 has an appropriate distance from the edge of the display panel in the box body 200, thereby enabling the packaging box applying the buffer structure 100 can be used for packaging display panels of different sizes.

It can be understood that in the above embodiments, the inserting hole 3131 in the adjustment rod 313 may be replaced by an inserting groove, the fixing member 33 can be inserted into the inserting groove, and the fixing member 33 protrudes from the inserting groove, a surface of a portion of the fixing member 33 protruding from the adjustment rod 313 can stop against the first surface 132.

In some embodiments, the fixing member 33 may be a buckle or a clip, and the fixing member 33 is connected to the adjusting rod 313 through clamping or sandwiched by the adjusting rod 313, so as to ensure that the fixing member 33 can remain fixedly on the adjusting rod 313, and the fixing member 33 protrudes from the surface of the adjusting rod 313 after being connected to the adjusting rod 313, as such the fixing member 33 stops against the first surface 132 near the adjusting hole 131. The fixing member 33 can be clamped or sandwiched at different positions of the adjusting rod 313 to adjust the distance between the connecting plate 311 and the second surface 134, and the above effect can also be achieved. The fixing member 33 can have the buckle structure and the clip structure, which are both within the scope of protection of the present disclosure.

In some embodiments of the present disclosure, the adjusting member 31 includes a plurality of adjusting rods 313, and the supporting plate 13 defines a plurality of adjusting holes 131. One end of each adjusting rod 313 connects to the connecting plate 311, while the other end is inserted into one corresponding adjusting hole 131.

In some embodiments, the plurality of adjusting rods 313 are connected to a surface of the connecting plate 311 at intervals, and the extending lengths of the adjusting rods 313 are the same and can be adjusted synchronously. Each adjusting member 31 defines a plurality of inserting holes 3131, and the inserting holes 3131 of each adjusting member 31 are correspondingly defined. The fixing members 33 can be one or more. When there are a plurality of fixing members 33, each fixing member 33 is inserted into one corresponding inserting hole 3131 of one adjusting rod 313, thereby stopping one end of each adjusting rod 313. When the quantity of the fixing member 33 is one, the fixing member 33 is merely inserted into one inserting hole 3131 of one adjusting rod 313. As long as a portion of the fixing member 33 protrudes from the surface of the adjusting rod 313 after being inserted into the inserting hole 3131, the portion can stop against the first surface 132, thereby preventing the adjusting rod 313 from moving along one direction. The plurality of adjusting rods 313 can stably support the connecting plate 311 so as to make the stress of the buffer member 50 and the connecting member more uniform and improve the buffer effect.

In some embodiments, the plurality of adjusting rods 313 are arranged side by side, and one fixing member 33 connects to a plurality of adjusting members 31 at the same time and stops against the first surface 132. In some embodiments, each adjusting rod 313 defines a plurality of inserting holes 3131 spaced from each other, the inserting hole 3131 on one adjusting rod 313 matches with another inserting hole 3131 on another one adjusting rod 313, and the fixing member 33 has a strip-shaped structure and can be inserted into corresponding inserting holes 3131 respectively in the plurality of adjusting rods 313 at the same time, so that only the matching relationship between the fixing member 33 and the inserting holes 3131 respectively in the plurality of adjusting rods 313 needs to be adjusted, that is, the space between the connecting plate 311 and the second surface 134 can be adjusted, and the structure is simple and prone to operate.

The fixing member 33 includes an inserting rod 331 and a limit part 333 connected to one end of the inserting rod 331. The radial dimension of the inserting rod 331 is smaller than the inner diameter of the inserting hole 3131, and the radial dimension of the limit part 333 is larger than the inner diameter of the inserting hole 3131. The inserting rod 331 passes through one corresponding inserting hole 3131 on each adjusting rod 313 along a direction away from the limit part 333, thereby connecting the plurality of adjusting rods 313 together to stop the plurality of adjusting rods 313 at the same time.

It can be understood that when the plurality of adjustment rods 313 do not have the inserting holes 3131, the fixing members 33 can also be buckles or shelves, one fixing member 33 is clamped or sandwiched by one adjustment rod 313, or the plurality of fixing members 33 are clamped or sandwiched by one adjustment rod 313, respectively, which can also achieve the technical effect in the above embodiments.

In some embodiments, each adjusting rod 313 may also be provided with a plurality of inserting grooves 202 spaced from each other, and there a plurality of fixing members 33, and each fixing member 33 is inserted into one corresponding inserting groove 202 on one adjusting rod 313 to achieve the above technical effect.

In some embodiments, the connecting plate 311 has a long side with a longer dimension and a short side with a shorter dimension, and the plurality of adjusting rods 313 are arranged side by side along the extending direction of the long side. In some embodiments, the connecting plate 311 has two opposite long sides and two opposite short sides, and the arrangement directions of the plurality of adjusting rods 313 coincide with the extension direction of the long sides, so that the connecting plate 311 is more stably supported along the direction of the long side. It may be understood that the connecting plate 311 may have other shapes such as trapezoid, triangle, or circle, and the arrangement directions of the plurality of adjusting rods 313 are the same as the direction of the long side of the connecting plate 311 having the larger size. If the connecting plate 311 has the same size in all directions, for example, the connecting plate 311 is circular, the arrangement direction of the adjusting rods 313 can be any direction passing through the center of the circle.

In some embodiments, the supporting plate 13 defines a limit groove 133, the second surface 134 is defined at the bottom surface of the limit groove 133, and the connecting plate 311 is matched with the limit groove 133 in shape. In some embodiments, when the distance between the connecting plate 311 and the second surface 134 is close enough, the movement direction of the connecting plate 311 is limited by the limit groove 133, so that the buffer member 50 can move more smoothly when being acted on by the display panel, and thus the buffer force received by the display panel is more stable.

In some embodiments of the present disclosure, the fixing frame 10 includes two supporting plates 13 cooperatively forming an angle, and the buffer structure 100 includes two adjustment components 30 and two buffer members 50. One supporting plate 13, one adjustment component 30, and one buffer member 50 are mounted together cooperatively, and the two buffer members 50 both face the display panel in the box body 200.

In some embodiments, the buffer structure 100 includes two supporting plates 13 cooperatively forming an angle, each supporting plate 13 supports one corresponding buffer member 50 through one adjusting component 30, and if an angle is defined between the two supporting plates 13, there is also an angle between the two buffer members 50, and the two buffer members 50 stop and buffer the corner of the display panel in the box body 200.

Figure 7:
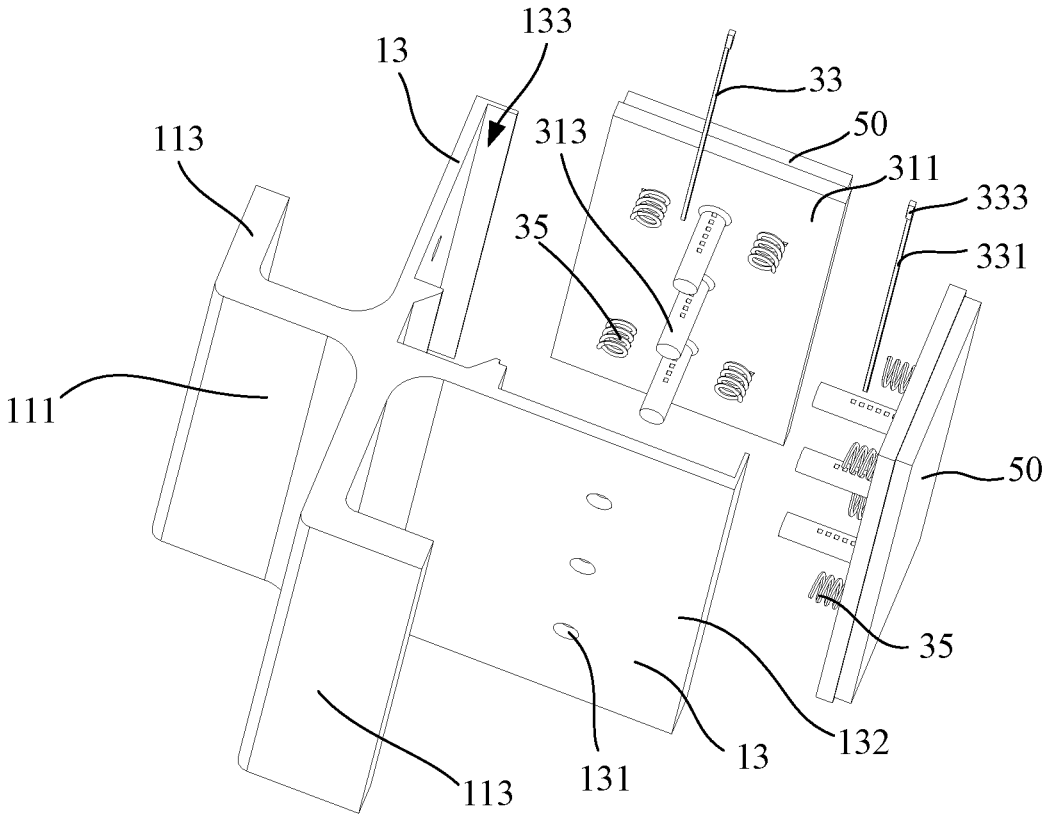
FIG. 7 is an exploded diagram of a part of the structure shown in FIG. 6.

Referring to FIG. 7, the fixing frame 10 includes two mounting plates 11, each of the mounting plates 11 is located on an extension line of one supporting plate 13. An angle is also defined between the two mounting plates 11. After the mounting plates 11 is connected to the box body 200, the two mounting plates 11 cooperatively forming an angle limit the fall-off of the buffer structure 100 from two directions respectively, so that the connection between the buffer structure 100 and the box body 200 is more stable.

Electively, the two supporting plates 13 are perpendicular to each other and the two mounting plates 11 are perpendicular to each other, and the fixing frame 10 has a cross structure.

In some embodiments, the edge of the mounting plate 11 away from the supporting plate 13 bends and extends toward sideways. The bending and extending structure of the mounting plate 11 can further increase the structural strength of the fixing frame 10, and the bending portion can further prevent the buffer structure 100 from falling off. The mounting plate 11 includes a first side plate 111 and a second side plate 113, the first side plate 111 connects to one supporting plate 13 and extends toward the extension line of the supporting plate 13, and the second side plate 113 connects to the side of the first side plate 111 away from the supporting plate 13 and extends toward the lateral direction of the first side plate 111. The second side plates 113 of the two mounting plates 11 extend towards opposite direction.

In the embodiment of the present disclosure, the buffer structure 100 should be mainly set as the corner position in the box body 200 of the packaging box, so as to prevent the four corners of the display panel from colliding with the buffer structure 100 at a short distance from the front, thus playing a better role in protecting the display panel. At the same time, the adjusting member 31 of the buffer structure 100 elastically abuts the second surface 134 of the supporting plate 13. When the display panel collides with the buffer structure 100, not only the buffer member 50 buffers the display panel, but also the elastic member 35 between the connecting plate 311 and the second surface 134 can absorb energy through deformation, thus playing a better role in protecting the display panel. When the display panel is not connected to the buffer structure 100, the elastic member 35 recovers its deformation, such allowing the connecting plate 311 to return to its original position, ensuring that the distance between the display panel and the buffer structure 100 is maintained within a safe range.

The present disclosure also provides a packaging box, which includes a box body 200 and a buffer structure 100. The specific structure of the buffer structure 100 refers to the above embodiments. As the packaging box adopts all the technical proposals of the above exemplary embodiments, the packaging box at least has all of the beneficial effects of the technical proposals of the above exemplary embodiments, no need to repeat again. The packaging box includes an inserting groove 202 matched with the connecting plate 311, and the connecting plate 311 is cooperatively inserted into the inserting groove 202.

Figure 3:
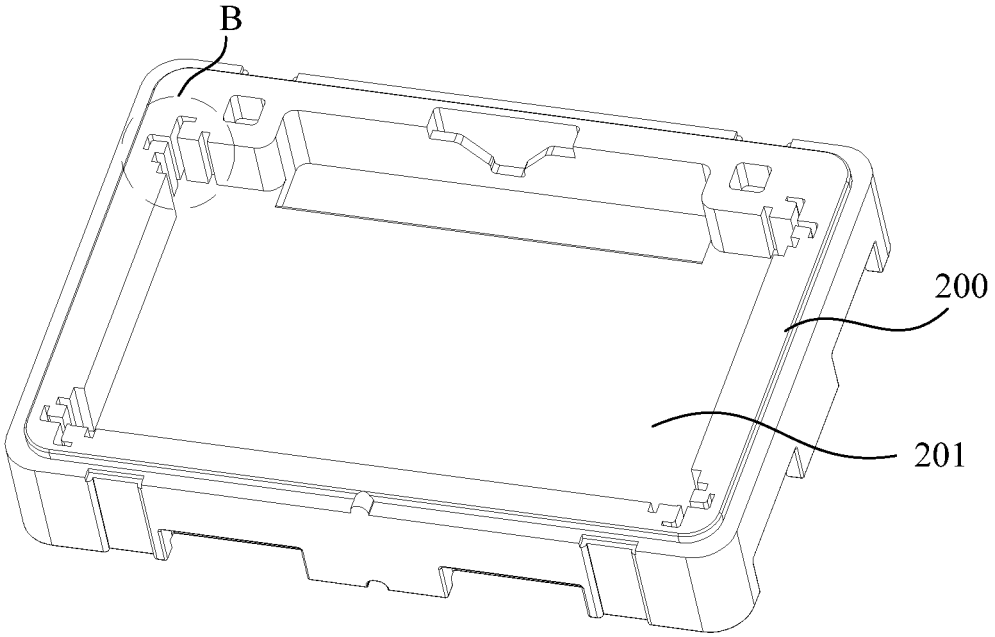
FIG. 3 is a structural diagram of the box body of the packaging box shown in FIG. 1.
Figure 4:
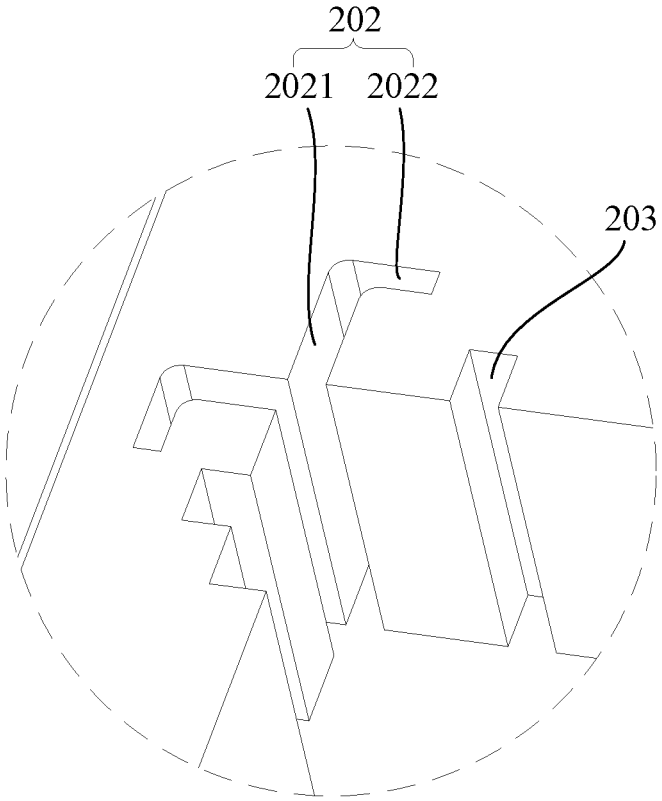
FIG. 4 is an enlarged diagram of portion B shown in FIG. 3.

Referring to FIGS. 3 and 4, the inner surface of the box body 200 defines an inserting groove 202 in which the connecting plate 53 is inserted, the supporting plate 13 connects to the connecting plate 53 and extends into the accommodating cavity 201, and the inner surface of the packaging box is also provided with an adapting groove 203 in which the fixing member 33 and a part of the adjusting rod 313 are accommodated, so that the first surface 132 of the supporting plate 13 can be fitted to the inner surface of the packaging box. When the buffer member 50 receives the force of the display panel, the force is transmitted to the supporting plate 13 through the adjustment component 30 and then transmitted to the box body 200, thereby protecting the buffer structure 100 and preventing the buffer structure 100 from being damaged.

In some embodiments, the inserting groove 202 includes a first inserting section 2021 and a second inserting section 2022 communicating with the first inserting section 2021, the first side plate 111 of the mounting plate 11 is inserted into the first inserting section 2021, and the second side plate 113 of the mounting plate 11 is inserted into the second inserting section 2022. In some embodiments, each second side plate 113 is respectively parallel to one corresponding supporting plate 13. After the buffer structure 100 is installed in the box body 200, the force applied to the buffer member 50 is transmitted to the supporting plate 13 through the adjustment component 30, and the inner side of the box body 200 supports the supporting plate 13. At the same time, the inner wall of the second inserting end also supports the second side plate 113, further ensuring the force applied to the buffer structure 100 uniform and preventing the buffer structure 100 from being damaged.

The foregoing description merely depicts some embodiments of the present application and therefore is not intended to limit the scope of the application. An equivalent structural or flow changes made by using the content of the specification and drawings of the present application, or any direct or indirect applications of the disclosure on any other related fields shall all fall in the scope of the application.

What is claimed is:

1. A buffer structure for use with a packaging box of a display panel, the packaging box comprising a box body, wherein the buffer structure comprises:

a fixing frame, the fixing frame comprises a mounting plate and a supporting plate, the mounting plate connects to the box body, the supporting plate comprises a first surface and a second surface arranged opposite to each other, and comprises an adjusting hole running through the first surface and the second surface;

at least one adjusting component, the adjusting component comprises at least one adjusting member, at least one fixing member, and at least one elastic member, the adjusting component passes through the adjusting hole, the fixing member connects to an end of the adjusting member and stops against the first surface, and the elastic member is clamped between the other end of the adjusting member and the second surface; and a buffer member, the buffer member connects to an end surface of the adjusting member and located on a side of the elastic member away from the supporting plate.

2. The buffer structure according to claim 1, wherein the adjusting member comprises an adjusting rod and a connecting plate, the adjusting rod passes through the adjusting hole, the fixing member connects to one end of the adjusting rod and stops against the first surface, the connecting plate connects to the other end of the adjusting rod, and the elastic member is clamped between the connecting plate and the second surface; and the buffer member connects to the surface of the connecting plate away from the adjusting rod.

3. The buffer structure according to claim 2, wherein one end of the elastic member is fixed to the connecting plate, and the other end of the elastic member abuts the second surface.

4. The buffer structure according to claim 2, wherein the adjusting rod passes through the adjusting hole along the extending direction of the adjusting rod, and comprises a plurality of inserting holes arranged side by side along an extending direction, and the fixing member is inserted into one inserting hole in the adjusting rod.

5. The buffer structure according to claim 4, wherein the fixing member comprises an inserting rod and a stop part connected to one end of the inserting rod, the radial dimension of the inserting rod is smaller than the inner diameter of the inserting hole, the radial dimension of the stop part is larger than the inner diameter of the inserting hole, and the inserting rod passes through one corresponding inserting hole in the adjusting rod along a direction away from the stop part.

6. The buffer structure according to claim 2, wherein the adjusting member comprises a plurality of adjusting rods, the supporting plate comprises a plurality of adjusting holes, one end of each adjusting rod connects to the connecting plate, and the other end of each adjusting rod passes through one corresponding adjusting hole.

7. The buffer structure according to claim 6, wherein the plurality of the adjusting rods are arranged side by side, and one of the fixing members connects to a plurality of the adjusting members simultaneously.

8. The buffer structure as claimed in claim 2, wherein the supporting plate defines a limit groove, the second surface is defined at the bottom of the limit groove, and the connecting plate matches with the limit groove in size.

9. The buffer structure according to claim 1, wherein the fixing frame comprises two supporting plates cooperatively forming an angle, the buffer structure comprises two adjusting components and two buffer members, one of the two supporting plates, one of the two adjusting components, and one of the two buffer members are cooperatively mounted together, and the two buffer members face the display panel in the box body.

10. The buffer structure as claimed in claim 9, wherein the fixing frame comprises two mounting plates, each of the mounting plates is defined at an extension line of one supporting plate.

11. The buffer structure as claimed in claim 10, wherein the two supporting plates are perpendicular to each other.

12. The buffer structure as claimed in claim 10, wherein an edge of the mounting plate away from the supporting plate bends and extends sideways.

13. A buffer structure for use with a packaging box of display panel, the packaging box comprising a box body, wherein the buffer structure comprises:

a fixing frame, the fixing frame comprises two mounting plates and two supporting plates, the two mounting plates are perpendicular to each other and respectively defined at an extension line of one of the supporting plates; the two mounting plates connect to the box body, each of the supporting plates comprises a first surface and a second surface opposite to the first surface, and comprises a plurality of adjusting holes passing through the first surface and the second surface;

two adjusting components, one adjusting component connects to one corresponding supporting plate, and the adjusting component comprises at least a connecting plate and a plurality of adjusting rods connected to the connecting plate, a fixing member, and a plurality of elastic members, each adjusting rod passes through one corresponding adjusting hole, and each adjusting rod comprises a plurality of inserting holes arranged side by side along the extending direction of the adjusting rod; the fixing member comprises an inserting rod and a stop part connected to one end of the inserting rod, the inserting rod passes through one corresponding inserting hole in each adjusting rod along a direction away from the stop part and stops against the first surface, and the plurality of elastic members are clamped between the connecting plate and the second surface; and a buffer member, the buffer member connects to a surface of the connecting plate away from the adjusting rod.

14. A packaging box, wherein the packaging box comprises a box body and a buffer structure, the buffer structure comprises:

a fixing frame, the fixing frame comprises a mounting plate and a supporting plate, the mounting plate connects to the box body, the supporting plate comprises a first surface and a second surface arranged opposite to each other, and comprises an adjusting hole running through the first surface and the second surface;

at least one adjusting component, the adjusting component comprises at least one adjusting member, at least one fixing member, and at least one elastic member, the adjusting component passes through the adjusting hole, the fixing member connects to an end of the adjusting member and stops against the first surface, and the elastic member is clamped between the other end of the adjusting member and the second surface; and a buffer member, the buffer member connects to an end surface of the adjusting member and located on a side of the elastic member away from the supporting plate;

the packaging box comprises an inserting groove matched with the mounting plate, and the mounting plate is cooperatively inserted into the inserting groove.

15. The packaging box according to claim 14, wherein the fixing frame comprises two supporting plates cooperatively forming an angle, the buffer structure comprises two adjusting components and two buffer members, one of the two supporting plates, one of the two adjusting components, and one of the two buffer members are cooperatively mounted together, and the two buffer members face the display panel in the box body.

16. The packaging box as claimed in claim 15, wherein the fixing frame comprises two mounting plates, each of the mounting plates is defined at an extension line of one supporting plate.

17. The packaging box as claimed in claim 16, wherein an edge of the mounting plate away from the supporting plate bends and extends sideways.

18. The packaging box according to claim 17, wherein the mounting plate comprises a first side plate and a second side plate, the first side plate connects to one supporting plate and extends toward an extension line of the supporting plate, and the second side plate connects to a side of the first side plate away from the supporting plate and extends toward a lateral direction of the first side plate; and the inserting groove comprises a first inserting section and a second inserting section communicating with the first inserting section, the first side plate is inserted into the first inserting section, and the second side plate is inserted into the second inserting section.

* * * * *